US012612088B2

(12) United States Patent
Tomida et al.

(10) Patent No.: US 12,612,088 B2
(45) Date of Patent: Apr. 28, 2026

(54) OBSTACLE DETECTION DEVICE AND OBSTACLE DETECTION METHOD

(71) Applicant: Mitsubishi Electric Corporation, Tokyo (JP)

(72) Inventors: Masashi Tomida, Tokyo (JP); Yukitoshi Inaba, Tokyo (JP); Ryosuke Kawanishi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 621 days.

(21) Appl. No.: 18/003,050

(22) PCT Filed: Jul. 6, 2020

(86) PCT No.: PCT/JP2020/026432
§ 371 (c)(1),
(2) Date: Dec. 22, 2022

(87) PCT Pub. No.: WO2022/009273
PCT Pub. Date: Jan. 13, 2022

(65) Prior Publication Data
US 2023/0249723 A1 Aug. 10, 2023

(51) Int. Cl.
*B61L 23/00* (2006.01)
*B61L 27/04* (2006.01)
*B61L 25/02* (2006.01)

(52) U.S. Cl.
CPC ..... *B61L 23/00* (2013.01); *B61L 27/04* (2013.01); *B61L 25/021* (2013.01); *B61L 25/025* (2013.01)

(58) Field of Classification Search
CPC ..... B61L 23/00; B61L 25/021; B61L 25/025; B61L 27/04
See application file for complete search history.

(56) References Cited

FOREIGN PATENT DOCUMENTS

CN 209719611 U 12/2019
JP 2019089373 A * 6/2019
(Continued)

OTHER PUBLICATIONS

Office Action issued in corresponding Indian Patent Application No. 202227077114, mailed on Mar. 6, 2023, 5 pages.
(Continued)

*Primary Examiner* — Robert J McCarry, Jr.
(74) *Attorney, Agent, or Firm* — BUCHANAN, INGERSOLL & ROONEY PC

(57) ABSTRACT

An obstacle detection device to be installed on a train includes: a sensor that monitors a monitoring region and outputs a monitoring result; an obstacle detection unit that determines presence or absence of an obstacle on a route on the basis of the monitoring result, and outputs a detection result; a monitoring distance determination unit that uses the detection result to determine a monitoring distance from the train to a reference; and a monitoring region determination unit that determines a monitoring region by using the monitoring distance, in which, when changing the monitoring distance, the monitoring distance determination unit acquires the monitoring region, and changes the monitoring distance such that a part of a monitored first monitoring region overlaps with a part of a second monitoring region based on the changed monitoring distance, in order not to generate a region not monitored.

14 Claims, 15 Drawing Sheets

(56) References Cited

FOREIGN PATENT DOCUMENTS

| | | | |
|---|---|---|---|
| JP | 2019188846 | A | 10/2019 |
| WO | 2019181019 | A1 | 9/2019 |

OTHER PUBLICATIONS

International Search Report (PCT/ISA/210) with English translation and Written Opinion (PCT/ISA/237) mailed Oct. 6, 2020, by the Japan Patent Office as the International Searching Authority for International Application No. PCT/JP2020/026432.

* cited by examiner

OBSTACLE DETECTION DEVICE AND OBSTACLE DETECTION METHOD

FIELD

The present disclosure relates to an obstacle detection device to be installed on a train and an obstacle detection method.

BACKGROUND

Conventionally, a train includes sensors such as a camera and a radar, and monitors whether or not there is an obstacle on a route. Such a technique is disclosed in Patent Literature 1. It is difficult for a sensor such as a camera or a radar to accurately monitor the entire range on the route of the train due to a focal point set by each device. Therefore, the train can perform effective monitoring by determining a reference distance from the train in consideration of a braking distance and the like and performing monitoring by narrowing a region on the basis of the reference distance.

CITATION LIST

Patent Literature

Patent Literature 1: Japanese Patent Application Laid-open No. 2019-188846

SUMMARY

Technical Problem

However, according to the conventional technique described above, in a case where an obstacle cannot be detected due to a cause that disturbs a visual field of the sensor, the train needs to change a distance in the monitoring process to enable detection of the obstacle. The cause that disturbs the visual field of the sensor is, for example, a weather condition such as fog or storm, and presence of a shielding object such as a building or a natural object around a railway track. In this case, when the monitoring distance is changed, there is a possibility that an unmonitored region may be made on the route of the train, and there has been a problem that the train may miss an obstacle on the route.

The present disclosure has been made in view of the above, and an object thereof is to obtain an obstacle detection device capable of changing a monitoring distance without missing an obstacle on a route of a train.

Solution to Problem

In order to solve the above problem and achieve the object, an obstacle detection device according to the present disclosure is installed on a train. The obstacle detection device includes: a sensor to monitor a monitoring region and output a monitoring result; an obstacle detection unit to determine presence or absence of an obstacle on a route of the train based on the monitoring result, and output a detection result; a monitoring distance determination unit to use the detection result to determine a monitoring distance from the train to a reference for monitoring by the sensor in front of the train; and a monitoring region determination unit to use the monitoring distance to determine the monitoring region to be monitored by the sensor. When changing the monitoring distance, the monitoring distance determination unit acquires the monitoring region from the monitoring region determination unit, and changes the monitoring distance such that a part of a first monitoring region that has been monitored overlaps with a part of a second monitoring region based on the changed monitoring distance, in order not to generate a region that is not monitored by the sensor on a route of the train.

Advantageous Effects of Invention

According to the present disclosure, there is an effect that the obstacle detection device can change a monitoring distance without missing an obstacle on a route of a train.

DESCRIPTION OF EMBODIMENTS

Hereinafter, an obstacle detection device and an obstacle detection method according to embodiments of the present disclosure will be described in detail with reference to the drawings.

First Embodiment

Figure 1:
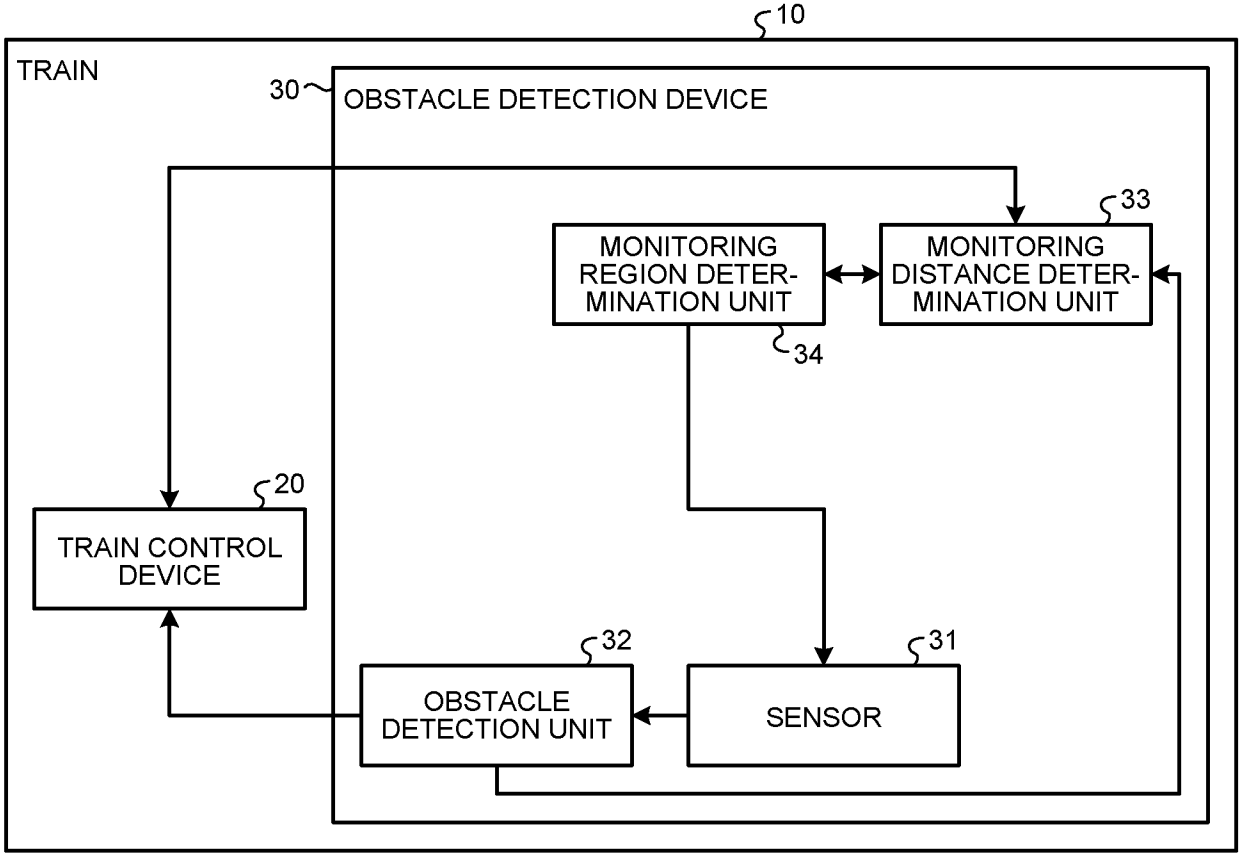
FIG. 1 is a diagram illustrating a configuration example of a train including an obstacle detection device according to a first embodiment.

FIG. 1 is a diagram illustrating a configuration example of a train 10 including an obstacle detection device 30 according to a first embodiment. The train 10 includes a train control device 20 and the obstacle detection device 30. During operation, the train 10 monitors whether or not there is an obstacle on a route by using the obstacle detection device 30.

The train control device 20 controls traveling of the train 10. Specifically, the train control device 20 detects a location and a speed of the train 10 by using a ground coil (not illustrated) installed on the ground, an on-board antenna (not illustrated) installed on the train 10, a tachometer generator, and the like. The train control device 20 outputs train location information indicating the detected location of the train 10 and train speed information indicating the detected speed of the train 10, to the obstacle detection device 30. A location detection method of the train 10 in the train control device 20 is a general method similar to a conventional method. In addition, upon acquiring a detection result indicating that an obstacle has been detected from an obstacle detection unit 32 to be described later, the train control device 20 performs control to stop or decelerate the train 10.

The obstacle detection device 30 is installed on the train 10 and monitors whether or not there is an obstacle on the route of the train 10. A configuration of the obstacle detection device 30 will be described. As illustrated in FIG. 1, the obstacle detection device 30 includes a sensor 31, the obstacle detection unit 32, a monitoring distance determination unit 33, and a monitoring region determination unit 34.

The sensor 31 performs monitoring in a monitoring region acquired from the monitoring region determination unit 34 to be described later, and detects an object. The object includes an obstacle that hinders traveling of the train 10 on the route of the train 10. The obstacle is, for example, an automobile or a person entering a railway track while a railroad crossing is blocked, a fallen rock from a cliff, a passenger who has fallen from a station platform, a wheelchair left behind at a railroad crossing, or the like. The sensor 31 is a measuring instrument capable of detecting these obstacles, and is, for example, a stereo camera including two or more cameras, light detection and ranging (LIDAR), radio detection and ranging (RADAR), or the like. The sensor 31 may include two or more measuring instruments.

The sensor 31 outputs a monitoring result, which is a result obtained by monitoring the monitoring region, to the obstacle detection unit 32. The monitoring result is a result of monitoring the monitoring region by the sensor 31, and is, for example, a two-dimensional image, a three-dimensional image, or the like. The sensor 31 is installed on a head car of the train 10. In a case where the train 10 is configured with a plurality of cars, the head car is changed according to a traveling direction, and thus the sensors 31 are installed on cars at both ends. For example, in a case where the train 10 is a 10-car train including the first to 10th cars, the first car or the 10th car is to be the head car according to the traveling direction. In this case, the sensors 31 are installed in the first car and the 10th car of the train 10. The obstacle detection device 30 uses the sensor 31 installed in the head car in the traveling direction of the train 10.

The obstacle detection unit 32 determines presence or absence of an obstacle on the route of the train 10 on the basis of the monitoring result acquired from the sensor 31. The obstacle detection unit 32 outputs a detection result indicating, in the monitoring result, the presence or absence of an obstacle, that is, whether or not an obstacle has been detected, to the train control device 20 and the monitoring distance determination unit 33. The detection result may be only information indicating whether or not an obstacle has been detected, or may include information on a location of the obstacle when the obstacle has been detected. Here, the sensor 31 monitors the route of the train 10 from the train 10 to the monitoring region. In a case where there is an obstacle between the train 10 and the monitoring region, the monitoring result may include, although not clear, information indicating that an obstacle is present. Therefore, the obstacle detection unit 32 may output information indicating that there is a possibility of presence of an obstacle in a region other than the monitoring region, as a detection result to the train control device 20 and the monitoring distance determination unit 33.

The monitoring distance determination unit 33 uses the detection result acquired from the obstacle detection unit 32, to determine a monitoring distance from the train 10 to a reference for monitoring by the sensor 31 in front of the train 10. In a case where the acquired detection result indicates that no obstacle has been detected, the monitoring distance determination unit 33 determines, as the monitoring distance, a monitoring distance defined based on performance of the sensor 31, a speed of the train 10, and the like. In a case where the acquired detection result indicates that an obstacle has been detected, the monitoring distance determination unit 33 determines, as the monitoring distance, a monitoring distance calculated based on a location or the like of the obstacle. The monitoring distance determination unit 33 outputs the determined monitoring distance to the monitoring region determination unit 34. The monitoring distance determination unit 33 may determine the monitoring distance by using the train location information, the train speed information, and the like acquired from the train control device 20. In addition, the monitoring distance determination unit 33 calculates a recommended train speed, which is a speed recommended in the train 10, together with the train control device 20 on the basis of the determined monitoring distance, the braking distance of the train 10, and the like.

The monitoring region determination unit 34 determines a monitoring region to be monitored by the sensor 31, by using the monitoring distance acquired from the monitoring distance determination unit 33. For example, the monitoring region determination unit 34 adds a first distance defined in a front-rear direction in the traveling direction of the train 10 to the monitoring distance, adds a second distance defined in a left-right direction of the train 10, which is a direction perpendicular to the traveling direction of the train 10, to the monitoring distance, to determine a region indicated by the added range as the monitoring region. The monitoring region determination unit 34 may acquire the train location information and the train speed information from the train control device 20 via the monitoring distance determination unit 33, and change the first distance and the second distance by using the train location information, the train speed information, and the like. In addition, the monitoring region determination unit 34 may set a range in a height direction of the monitoring region. A shape and a range of the monitoring region may be identical or different on a side closer to the train 10 and a side farther from the train 10. The monitoring region determination unit 34 outputs the determined monitoring region to the sensor 31.

Next, an action of the obstacle detection device 30 will be described. In the present embodiment, the monitoring distance determination unit 33 acquires the monitoring region from the monitoring region determination unit 34, when the monitoring distance is changed based on the detection result or the like acquired from the obstacle detection unit 32. The monitoring distance determination unit 33 changes the monitoring distance such that a part of a monitored first monitoring region overlaps with a part of a second monitoring region based on the changed monitoring distance, in order not to generate a region not monitored by the sensor 31 on the route of the train 10. For example, in a case where the monitoring distance determination unit 33 acquires a detection result indicating that there is a possibility of presence of an obstacle in a region other than the monitoring region from the obstacle detection unit 32, the monitoring distance determination unit 33 determines the monitoring distance so as to be nearer, that is, shorter than the current monitoring distance, in order to check whether or not an obstacle is present.

After shortening the monitoring distance, in a case where the obstacle is no longer present on the route of the train 10 as the obstacle has moved or the like, the monitoring distance determination unit 33 returns the monitoring distance to an original monitoring distance. At this time, if the monitoring distance determination unit 33 suddenly changes the monitoring distance, there is a possibility that a region not monitored by the sensor 31 may be generated on the route of the train 10. Therefore, the monitoring distance determination unit 33 changes the monitoring distance such that a part of a monitored first monitoring region overlaps with a part of a second monitoring region based on the changed monitoring distance, in order not to generate the region not monitored by the sensor 31 on the route of the train 10. Note that the monitoring distance determination unit 33 assumes that a size of the monitoring region determined by using a previous monitoring distance and a size of the monitoring region determined by using a latest monitoring distance after the change are identical, for the monitoring region determined by the monitoring region determination unit 34. Therefore, in a case where the previous monitoring distance acquired from the monitoring distance determination unit 33 is different from the latest monitoring distance, the monitoring region determination unit 34 determines the monitoring region such that the size of the monitoring region determined by using the latest monitoring distance is identical to the size of the monitoring region determined by using the previous monitoring distance.

Figure 2:
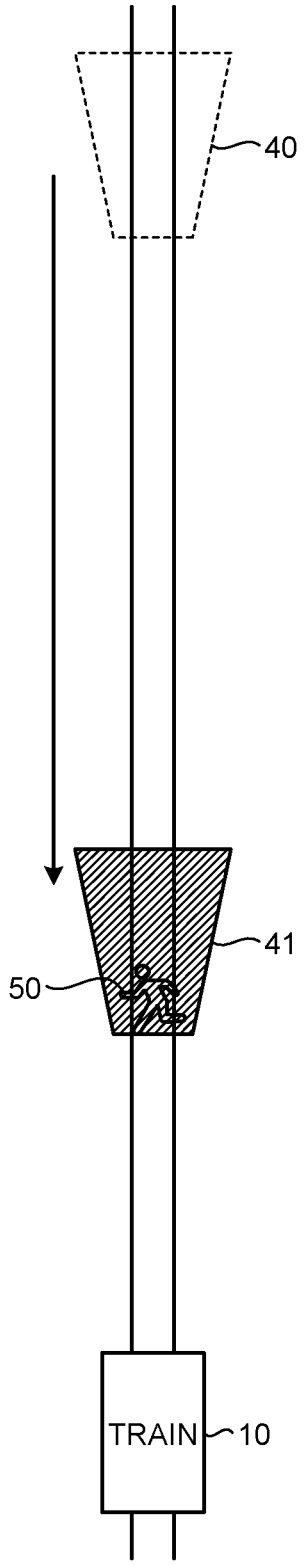
FIG. 2 is a diagram illustrating an example of a state in which an obstacle is present between the train and a monitoring region when the obstacle detection device according to the first embodiment monitors the monitoring region.
Figure 3:
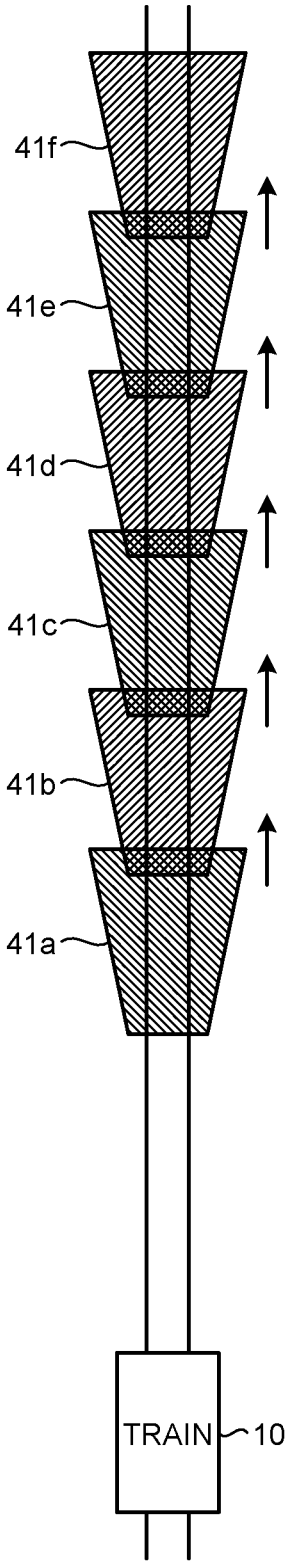
FIG. 3 is a diagram illustrating imagery of a change in monitoring region when the obstacle detection device according to the first embodiment changes a monitoring distance.

FIG. 2 is a diagram illustrating an example of a state in which an obstacle 50 is present between the train 10 and a monitoring region when the obstacle detection device 30 according to the first embodiment monitors the monitoring region. FIG. 2 illustrates a state in which the obstacle detection device 30 determines that the detected object may be the obstacle 50, shortens the monitoring distance, and changes the monitoring region from a monitoring region 40 to a monitoring region 41. FIG. 3 is a diagram illustrating imagery of a change in monitoring region when the obstacle detection device 30 according to the first embodiment changes the monitoring distance. FIG. 3 illustrates a state in which the obstacle detection device 30 changes the monitoring distance as the obstacle 50 is no longer present, and changes the monitoring region from a monitoring region 41*a* to a monitoring region 41*b*, a monitoring region 41*c*, a monitoring region 41*d*, a monitoring region 41*e*, and a monitoring region 41*f* in this order. In FIG. 3, a relationship between the monitoring regions 41*a* and 41*b* is that the monitoring region 41*a* is a first monitoring region and the monitoring region 41*b* is a second monitoring region. This similarly applies to other adjacent monitoring regions. Note that, in FIGS. 2 and 3, the traveling direction of the train 10 is a direction from a lower side to an upper side of the figure. In this manner, in the obstacle detection device 30, the monitoring distance determination unit 33 changes the monitoring distance such that a region not monitored by the sensor 31 is not generated on the route of the train 10.

Note that, as a specific example in which the monitoring distance determination unit 33 changes the monitoring distance, a case where there is an obstacle between the train 10 and the monitoring region has been described, but the present disclosure is not limited thereto. For example, as described above, the monitoring region includes not only the traveling direction of the train 10 but also the left-right direction of the train 10. In this case, the objects detected by the sensor 31 include structures such as traffic lights and buildings on a wayside of the route of the train 10, and wayside features that are natural objects such as trees and cliffs on a wayside of the route of the train 10. In a case where the obstacle detection unit 32 determines, on the basis of the monitoring result acquired from the sensor 31, that there is a certain object in a region other than the monitoring region even if the obstacle or the wayside feature cannot be specified, the obstacle detection unit 32 may output information indicating that there is a possibility of presence of an obstacle or a wayside feature in a region other than the monitoring region, as a detection result to the train control device 20 and the monitoring distance determination unit 33. When the monitoring distance determination unit 33 acquires, from the obstacle detection unit 32, a detection result indicating that there is a possibility of presence of an obstacle or a wayside feature in a region other than the monitoring region, the monitoring distance determination unit 33 may change the monitoring distance such that a part of a monitored first monitoring region overlaps with a part of a second monitoring region based on the changed monitoring distance.

Figure 4:
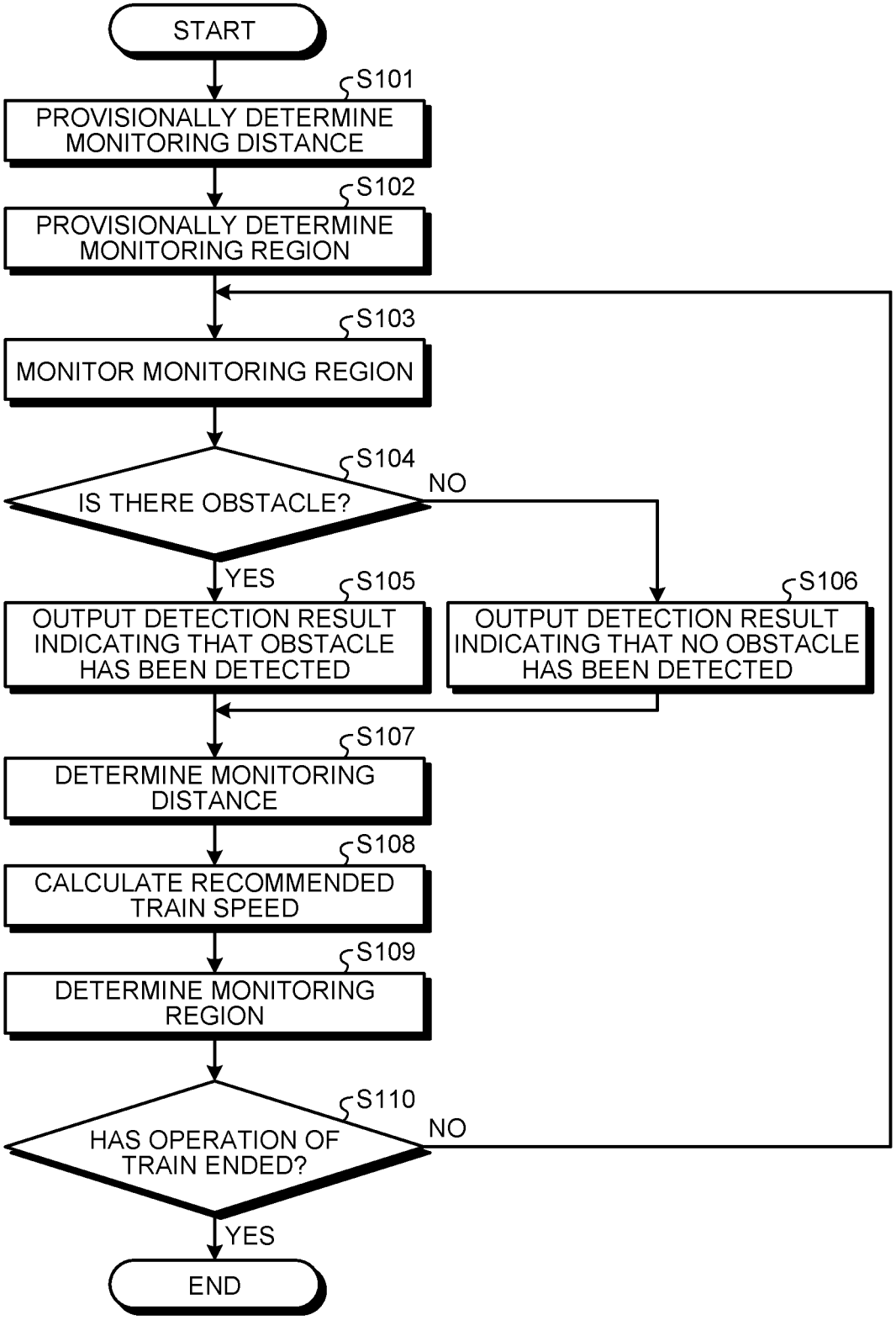
FIG. 4 is a flowchart illustrating an action of the obstacle detection device according to the first embodiment.

An action of the obstacle detection device 30 according to the present embodiment will be described with reference to a flowchart. FIG. 4 is a flowchart illustrating an action of the obstacle detection device 30 according to the first embodiment. When the train 10 is activated, in the obstacle detection device 30, the monitoring distance determination unit 33 provisionally determines a monitoring distance (step S101). For example, the monitoring distance determination unit 33 provisionally determines a predetermined monitoring distance as the monitoring distance. The monitoring distance determination unit 33 outputs the provisionally determined monitoring distance to the monitoring region determination unit 34. The monitoring region determination unit 34 provisionally determines a monitoring region by using the provisionally determined monitoring distance (step S102). For example, the monitoring region determination unit 34 provisionally determines the monitoring region by adding a predetermined distance to the provisionally determined monitoring distance. The monitoring region determination unit 34 outputs the provisionally determined monitoring region to the sensor 31.

The sensor 31 performs monitoring in the monitoring region acquired from the monitoring region determination unit 34 (step S103). Immediately after activation of the train 10, the sensor 31 cannot acquire the monitoring region based on the above-described method from the monitoring region determination unit 34. Therefore, immediately after activation of the train 10, the sensor 31 performs monitoring in the provisionally determined monitoring region. The sensor 31 outputs a monitoring result to the obstacle detection unit 32. The obstacle detection unit 32 determines presence or absence of an obstacle on the basis of the monitoring result acquired from the sensor 31 (step S104). When there is an obstacle (step S104: Yes), the obstacle detection unit 32 outputs a detection result indicating that an obstacle has been detected, to the train control device 20 and the monitoring distance determination unit 33 (step S105). When there is no obstacle (step S104: No), the obstacle detection unit 32 outputs a detection result indicating that no obstacle has been detected, to the train control device 20 and the monitoring distance determination unit 33 (step S106).

The monitoring distance determination unit 33 determines a monitoring distance by using the detection result acquired from the obstacle detection unit 32 (step S107). The monitoring distance determination unit 33 outputs the determined monitoring distance to the monitoring region determination unit 34. In addition, the monitoring distance determination unit 33 calculates a recommended train speed of the train 10 together with the train control device 20, by using the detection result acquired from the obstacle detection unit 32 (step S108). Note that the monitoring distance determination unit 33 may change the order of the actions in steps S107 and S108, or may perform the actions in parallel. The monitoring region determination unit 34 determines a monitoring region by using the monitoring distance acquired from the monitoring distance determination unit 33 (step S109). The monitoring region determination unit 34 outputs the determined monitoring region to the sensor 31.

The obstacle detection device 30 determines whether or not the operation of the train 10 has ended (step S110). When the operation of the train 10 has not ended (step S110: No), the obstacle detection device 30 returns to step S103 and repeats the above-described action. When the operation of the train 10 has ended (step S110: Yes), the obstacle detection device 30 ends the action.

Next, a hardware configuration of the obstacle detection device 30 will be described. In the obstacle detection device 30, the sensor 31 is a measuring instrument such as a stereo camera or a LIDAR as described above. The obstacle detection unit 32, the monitoring distance determination unit 33, and the monitoring region determination unit 34 are implemented by processing circuitry. The processing circuitry may be a memory and a processor that executes a program stored in the memory, or may be dedicated hardware.

Figure 5:
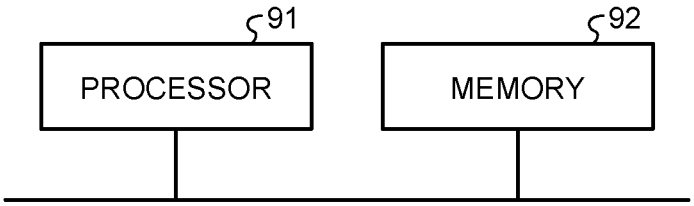
FIG. 5 is a diagram illustrating an example of a case where processing circuitry included in the obstacle detection device according to the first embodiment is configured with a processor and a memory.

FIG. 5 is a diagram illustrating an example of a case where the processing circuitry included in the obstacle detection device 30 according to the first embodiment is configured with a processor and a memory. In a case where the processing circuitry is configured with a processor 91 and a memory 92, each function of the processing circuitry of the obstacle detection device 30 is implemented by software, firmware, or a combination of software and firmware. The software or the firmware is described as a program and stored in the memory 92. In the processing circuitry, the processor 91 reads and executes the program stored in the memory 92 to implement each function. That is, the processing circuitry includes the memory 92 for storage of a program by which processing of the obstacle detection device 30 is executed as a result. It can also be said that these programs cause a computer to execute a procedure and a method of the obstacle detection device 30.

Here, the processor 91 may be a central processing unit (CPU), a processing device, an arithmetic device, a microprocessor, a microcomputer, a digital signal processor (DSP), or the like. Further, the memory 92 corresponds to a nonvolatile or volatile semiconductor memory such as a random access memory (RAM), a read only memory (ROM), a flash memory, an erasable programmable ROM (EPROM), or an electrically EPROM (EEPROM, registered trademark), a magnetic disk, a flexible disk, an optical disk, a compact disk, a mini disk, or a digital versatile disc (DVD).

Figure 6:
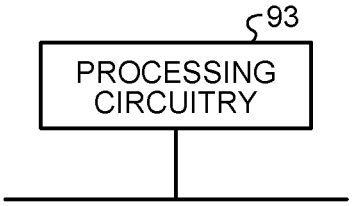
FIG. 6 is a diagram illustrating an example of a case where processing circuitry included in the obstacle detection device according to the first embodiment is configured with dedicated hardware.

FIG. 6 is a diagram illustrating an example of a case where the processing circuitry included in the obstacle detection device 30 according to the first embodiment is configured with dedicated hardware. In a case where the processing circuitry is configured with dedicated hardware, processing circuitry 93 illustrated in FIG. 6 corresponds to, for example, a single circuit, a composite circuit, a programmed processor, a parallel-programmed processor, an application specific integrated circuit (ASIC), a field programmable gate array (FPGA), or a combination thereof. Individual functions of the obstacle detection device 30 may be implemented by the processing circuitry 93 for each function, or the individual functions may be collectively implemented by the processing circuitry 93.

Note that some of the individual functions of the obstacle detection device 30 may be implemented by dedicated hardware, and some of the individual functions may be implemented by software or firmware. In this manner, the processing circuitry can implement the individual functions described above by dedicated hardware, software, firmware, or a combination thereof.

As described above, according to the present embodiment, in the obstacle detection device 30, the monitoring distance determination unit 33 acquires the monitoring region from the monitoring region determination unit 34 when the monitoring distance is changed by using the detection result acquired from the obstacle detection unit 32, and changes the monitoring distance such that a part of a monitored first monitoring region overlaps with a part of a second monitoring region based on the changed monitoring distance, in order not to generate a region not monitored by the sensor 31 on the route of the train 10. As a result, the obstacle detection device 30 can change the monitoring distance without missing an obstacle on the route of the train 10.

Second Embodiment

In a second embodiment, an obstacle detection device determines a monitoring distance in consideration of a monitorable region of the sensor 31 under a current monitoring condition.

Figure 7:
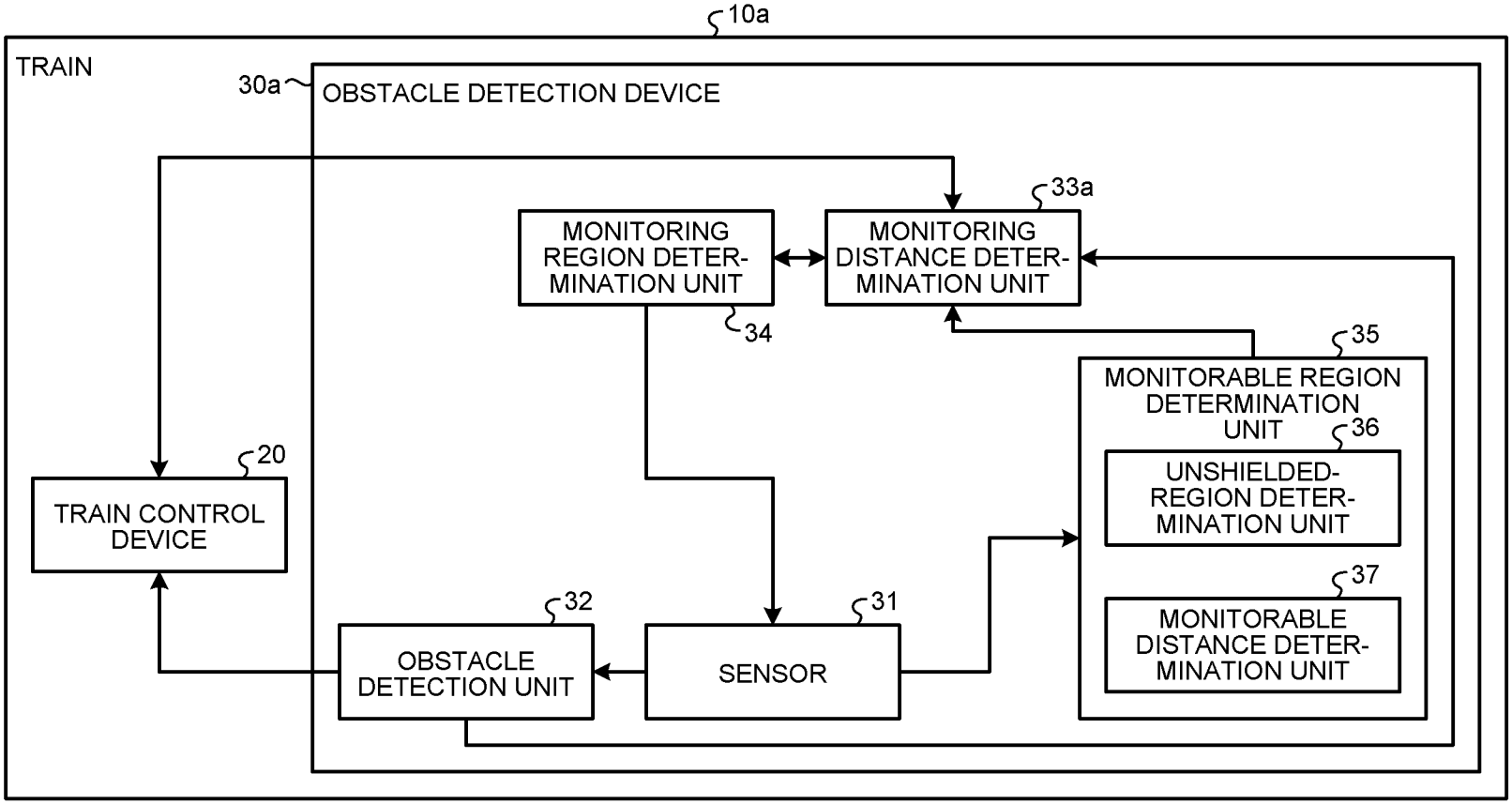
FIG. 7 is a diagram illustrating a configuration example of a train including an obstacle detection device according to a second embodiment.

FIG. 7 is a diagram illustrating a configuration example of a train 10*a* including an obstacle detection device 30*a* according to the second embodiment. The train 10*a* includes the train control device 20 and the obstacle detection device 30*a*. During operation, the train 10*a* monitors whether or not there is an obstacle on a route by using the obstacle detection device 30*a*. The obstacle detection device 30*a* is installed on the train 10*a* and monitors whether or not there is an obstacle on the route of the train 10*a*. The obstacle detection device 30*a* includes the sensor 31, the obstacle detection unit 32, a monitoring distance determination unit 33*a*, the monitoring region determination unit 34, and a monitorable region determination unit 35. The monitorable region determination unit 35 includes an unshielded-region determination unit 36 and a monitorable distance determination unit 37.

The unshielded-region determination unit 36 determines an unshielded region, which is not subjected to monitoring interference by a shielding object, which is an object other than an obstacle and hinders monitoring of the sensor 31 at a location other than the route of the train 10*a*. The shielding object is, for example, a structure on a wayside of the route of the train 10*a* or a wayside feature such as a natural object on a wayside of the route of the train 10*a*. For example, the unshielded-region determination unit 36 holds 3D map information on wayside features, and determines the unshielded region by using the 3D map information and train location information of the train 10*a* acquired from the train control device 20 or the monitoring distance determination unit 33*a*. Furthermore, in a case where the sensor 31 is a measuring instrument that uses a reflected wave of a laser with a laser sensor or the like, the unshielded-region determination unit 36 may determine the unshielded region on the basis of presence or absence of the reflected wave from the laser. For example, in a monitoring result of monitoring the monitoring region by the sensor 31, the unshielded-region determination unit 36 can determine that there is no object in a region where the reflected wave of the laser has not returned, and regard as the unshielded region. Furthermore, in a case where the sensor 31 is a stereo camera, the unshielded-region determination unit 36 may create a disparity map, calculate a distance, and determine the unshielded region. Further, when there are a plurality of shielding objects having a columnar shape in front on the route of the train 10*a*, the unshielded-region determination unit 36 may generate a largest convex closure inscribed in a region that is not shielded, and set the generated convex closure as the unshielded region, since a monitoring state is unstable even if a longer distance than the shielding object is partially seen.

The monitorable distance determination unit 37 determines a monitorable distance, which is a distance that can be monitored by the sensor 31 under a current monitoring condition. In a case where the sensor 31 is a measuring instrument such as a stereo camera or LIDAR as described above, the monitorable distance is affected by weather conditions, for example, fog, storm, and the like. Therefore, the monitorable distance determination unit 37 determines the monitorable distance on the basis of the monitoring result acquired from the sensor 31. For example, in a case where a mast located on a wayside of the route of the train 10*a* can be detected in the monitoring result, the monitorable distance determination unit 37 can estimate the monitorable distance from an average interval between the masts based on the number of masts that can be detected. In addition, the monitorable distance determination unit 37 may acquire weather information or the like of a region where the train 10*a* travels, from an external network or the like (not illustrated), and use the information for determination of the monitorable distance.

The monitorable region determination unit 35 determines the monitorable region of the sensor 31 under a current monitoring condition on the basis of the unshielded region determined by the unshielded-region determination unit 36 and the monitorable distance determined by the monitorable distance determination unit 37. The monitorable region determination unit 35 outputs the determined monitorable region to the monitoring distance determination unit 33*a*.

The monitoring distance determination unit 33*a* determines the monitoring distance within a range of the monitorable region determined by the monitorable region determination unit 35. For example, in a case where a monitorable region of the sensor 31 under a previous monitoring condition and a monitorable region of the sensor 31 under a current monitoring condition are different, the monitorable regions being determined by the monitorable region determination unit 35, the monitoring distance determination unit 33*a* changes the monitoring distance such that a part of the first monitoring region overlaps with a part of the second monitoring region.

Figure 8:
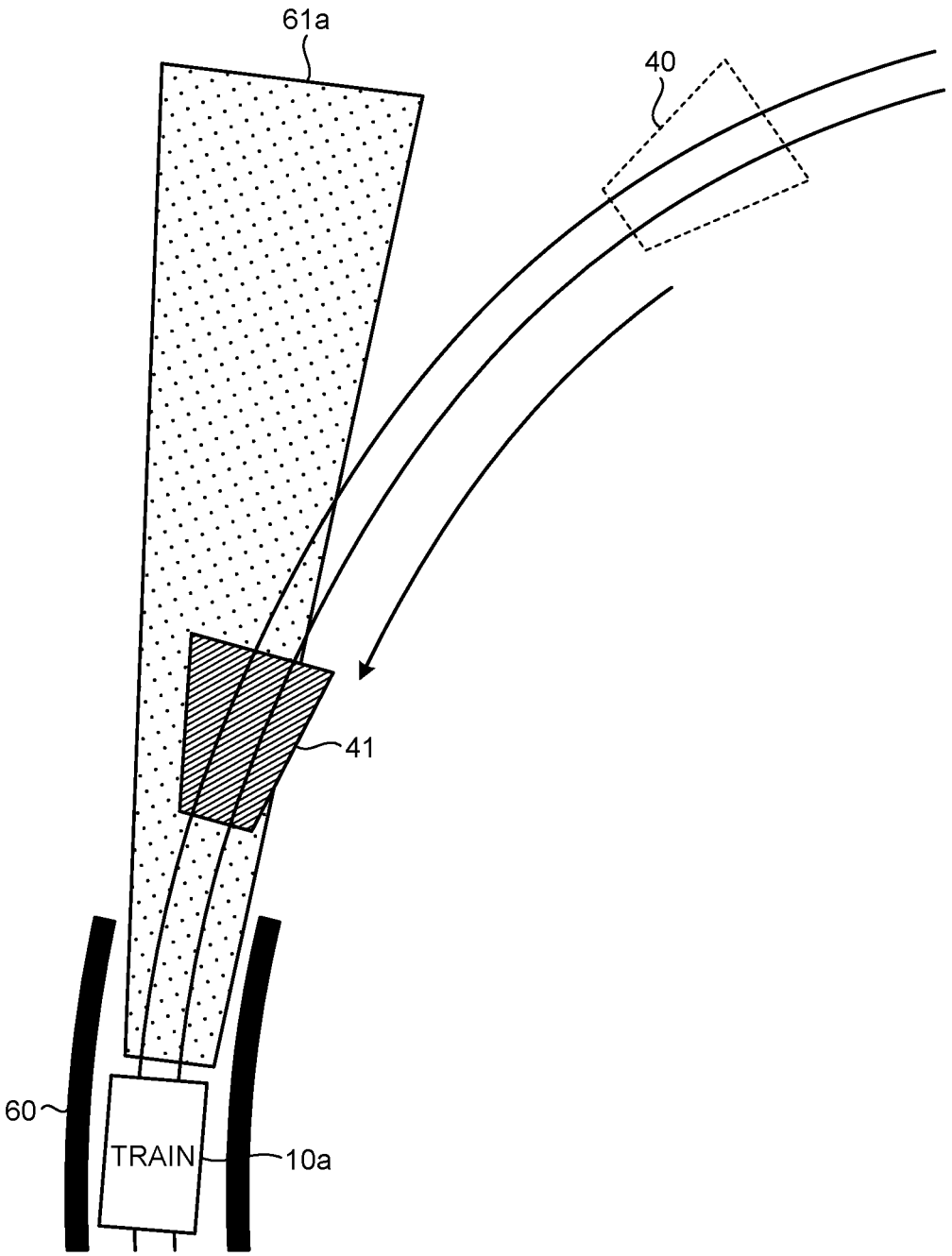
FIG. 8 is a diagram illustrating a state in which a monitoring distance determination unit of the obstacle detection device according to the second embodiment shortens a monitoring distance as a shielding object is present.
Figure 9:
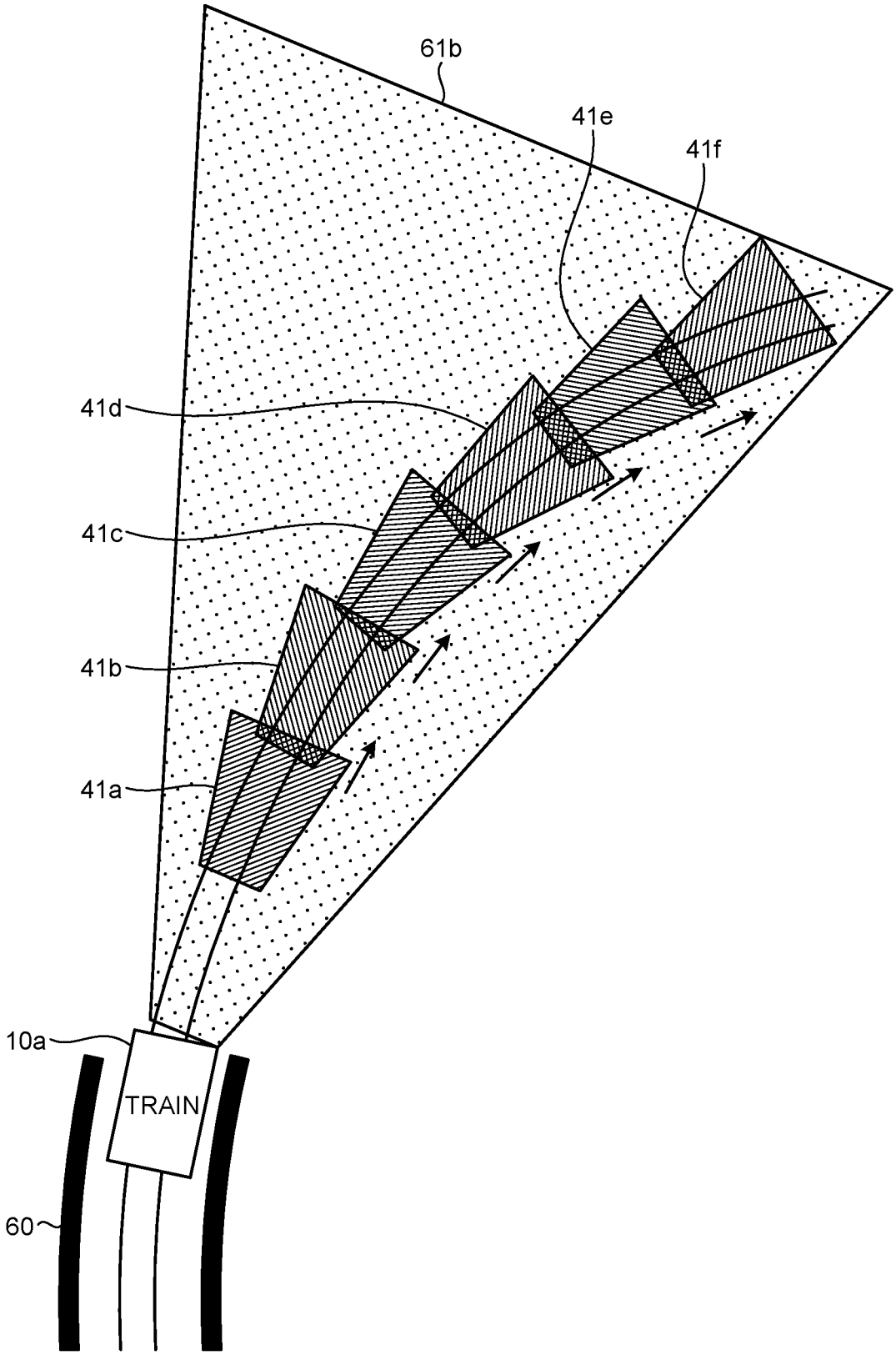
FIG. 9 is a diagram illustrating imagery of a change in monitoring distance when the monitoring distance determination unit of the obstacle detection device according to the second embodiment returns the monitoring distance to an original state as the shielding object is no longer present.

FIG. 8 is a diagram illustrating a state in which the monitoring distance determination unit 33*a* of the obstacle detection device 30*a* according to the second embodiment shortens the monitoring distance as a shielding object is present. FIG. 8 illustrates a state in which the obstacle detection device 30*a* changes the monitoring region from the monitoring region 40 to the monitoring region 41 when the monitorable region is narrowed as indicated by a monitorable region 61*a* by a tunnel 60 which is a shielding object. FIG. 9 is a diagram illustrating imagery of a change in monitoring distance when the monitoring distance determination unit 33*a* of the obstacle detection device 30*a* according to the second embodiment returns the monitoring distance to an original state as the shielding object is no longer present. FIG. 9 illustrates a state in which the obstacle detection device 30*a* changes the monitoring distance as the monitorable region becomes an original monitorable region 61*b* as the tunnel 60 as a shielding object is passed, and the obstacle detection device 30*a* changes the monitoring region from the monitoring region 41*a* to the monitoring region 41*b*, the monitoring region 41*c*, the monitoring region 41*d*, the monitoring region 41*e*, and the monitoring region 41*f* in this order. Note that, in FIGS. 8 and 9, a traveling direction of the train 10*a* is a direction from a lower left side to an upper right side of the figure. In this manner, in the obstacle detection device 30*a*, the monitoring distance determination unit 33*a* changes the monitoring distance such that a region not monitored by the sensor 31 is not generated on the route of the train 10*a*.

Figure 10:
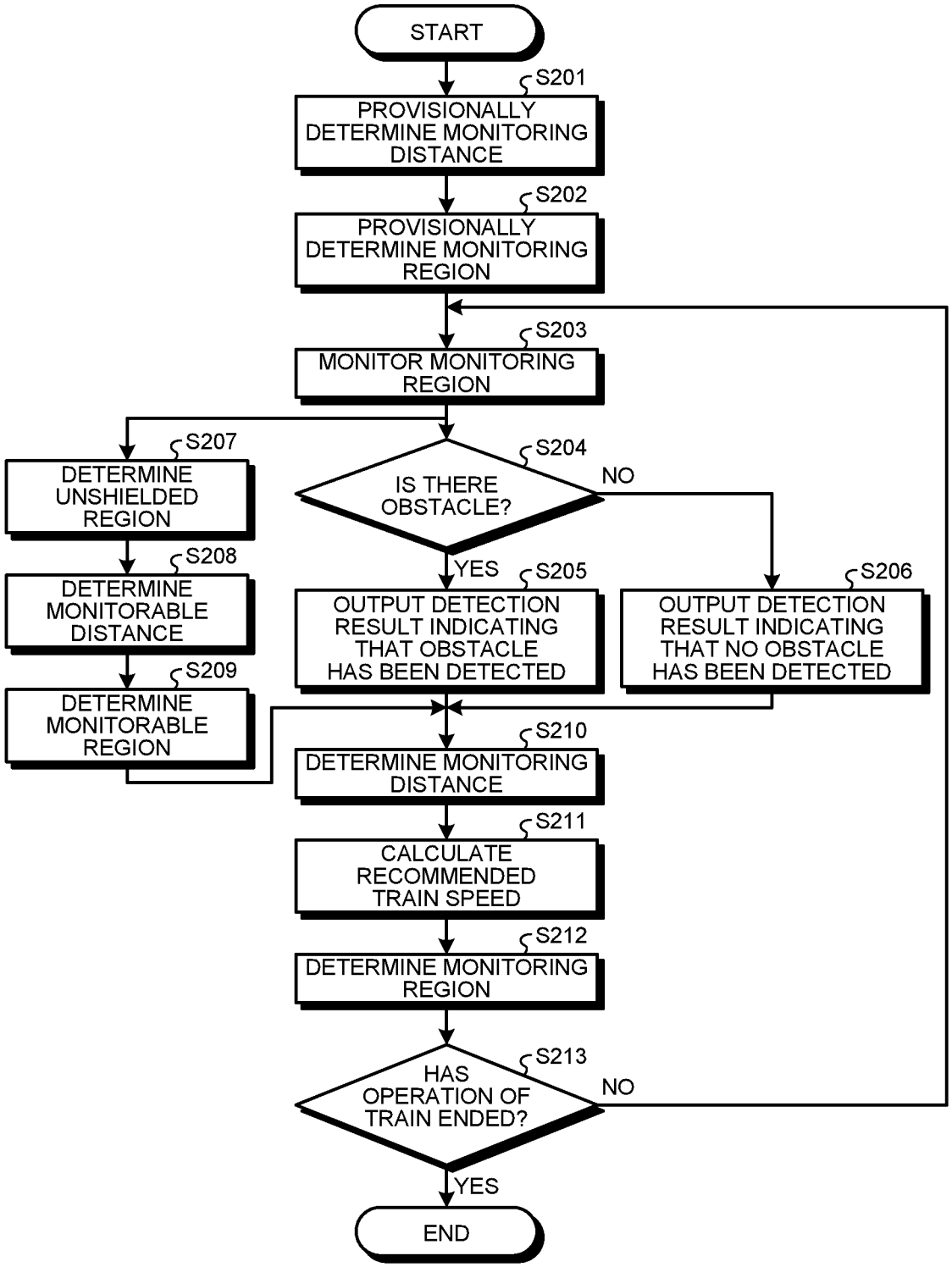
FIG. 10 is a flowchart illustrating an action of the obstacle detection device according to the second embodiment.

An action of the obstacle detection device 30*a* of the present embodiment will be described with reference to a flowchart. FIG. 10 is a flowchart illustrating an action of the obstacle detection device 30*a* according to the second embodiment. Note that descriptions of parts similar to the action of the obstacle detection device 30 of the first embodiment will be simplified. When the train 10*a* is activated, in the obstacle detection device 30*a*, the monitoring distance determination unit 33*a* provisionally determines a monitoring distance (step S201). The monitoring region determination unit 34 provisionally determines a monitoring region by using the provisionally determined monitoring distance (step S202). The sensor 31 performs monitoring in the monitoring region acquired from the monitoring region determination unit 34 (step S203). The sensor 31 outputs a monitoring result to the obstacle detection unit 32 and the monitorable region determination unit 35.

The obstacle detection unit 32 determines presence or absence of an obstacle on the basis of the monitoring result acquired from the sensor 31 (step S204). When there is an obstacle (step S204: Yes), the obstacle detection unit 32 outputs a detection result indicating that an obstacle has been detected, to the train control device 20 and the monitoring distance determination unit 33*a* (step S205). When there is no obstacle (step S204: No), the obstacle detection unit 32 outputs a detection result indicating that no obstacle has been detected, to the train control device 20 and the monitoring distance determination unit 33*a* (step S206).

The unshielded-region determination unit 36 determines an unshielded region that is not subjected to monitoring interference by a shielding object at a location other than the route of the train 10*a* (step S207). The monitorable distance determination unit 37 determines a monitorable distance by the sensor 31 under a current monitoring condition (step S208). The monitorable region determination unit 35 determines a monitorable region on the basis of the unshielded region determined by the unshielded-region determination unit 36 and the monitorable distance determined by the monitorable distance determination unit 37 (step S209). The monitorable region determination unit 35 outputs the determined monitorable region to the monitoring distance determination unit 33*a*.

The monitoring distance determination unit 33*a* determines a monitoring distance by using the detection result acquired from the obstacle detection unit 32 and the monitorable region acquired from the monitorable region determination unit 35 (step S210). In addition, the monitoring distance determination unit 33*a* calculates a recommended train speed of the train 10*a* together with the train control device 20, by using the detection result acquired from the obstacle detection unit 32 and the monitorable region acquired from the monitorable region determination unit 35 (step S211). Note that the monitoring distance determination unit 33*a* may change the order of the actions in steps S210 and S211, or may perform the actions in parallel. The monitoring region determination unit 34 determines a monitoring region by using the monitoring distance acquired from the monitoring distance determination unit 33*a* (step S212). The monitoring region determination unit 34 outputs the monitoring region to the sensor 31.

The obstacle detection device 30*a* determines whether or not the operation of the train 10*a* has ended (step S213). When the operation of the train 10*a* has not ended (step S213: No), the obstacle detection device 30*a* returns to step S203 and repeats the above-described action. When the operation of the train 10*a* has ended (step S213: Yes), the obstacle detection device 30*a* ends the action.

Regarding a hardware configuration of the obstacle detection device 30*a*, the monitoring distance determination unit 33*a* and the monitorable region determination unit 35 are implemented by processing circuitry. The processing circuitry may be a memory and a processor that executes a program stored in the memory, or may be dedicated hardware.

As described above, according to the present embodiment, in the obstacle detection device 30*a*, the monitoring distance determination unit 33*a*determines the monitoring distance by using the monitoring result and the monitorable region. As a result, in addition to the effects of the first embodiment, the obstacle detection device 30*a* can avoid unnecessary monitoring, by monitoring in a monitorable region without monitoring a long distance in a state where the sensor 31 cannot monitor a long distance.

Third Embodiment

In a third embodiment, an obstacle detection device determines a monitoring distance so as to track an obstacle detected by the obstacle detection unit 32.

Figure 11:
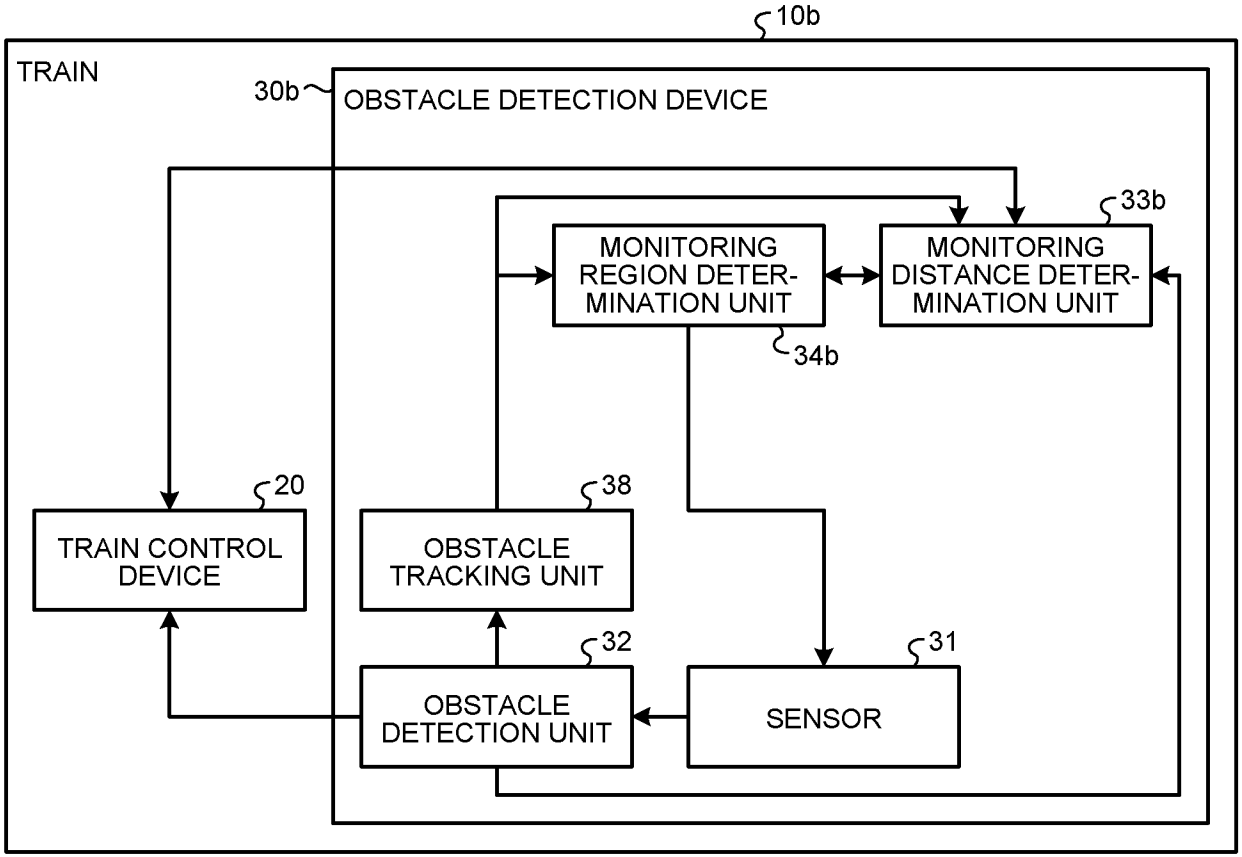
FIG. 11 is a diagram illustrating a configuration example of a train including an obstacle detection device according to a third embodiment.

FIG. 11 is a diagram illustrating a configuration example of a train 10*b* including an obstacle detection device 30*b* according to the third embodiment. The train 10*b* includes the train control device 20 and the obstacle detection device 30*b*. During operation, the train 10*b* monitors whether or not there is an obstacle on a route by using the obstacle detection device 30*b*. The obstacle detection device 30*b* is installed on the train 10*b* and monitors whether or not there is an obstacle on the route of the train 10*b*. The obstacle detection device 30*b* includes the sensor 31, the obstacle detection unit 32, a monitoring distance determination unit 33*b*, a monitoring region determination unit 34*b*, and an obstacle tracking unit 38. In the third embodiment, the obstacle detection unit 32 outputs a detection result to the train control device 20, the monitoring distance determination unit 33*b*, and the obstacle tracking unit 38.

The obstacle tracking unit 38 uses a time-series detection result of the obstacle detected by the obstacle detection unit 32, to track the detected obstacle in association. The obstacle tracking unit 38 outputs tracking information indicating a location of the obstacle, to the monitoring distance determination unit 33*b* and the monitoring region determination unit 34*b*. The obstacle tracking unit 38 may include information such as a size and a shape of the obstacle and a moving speed of the obstacle, in the tracking information.

The monitoring distance determination unit 33*b* determines a monitoring distance by using the detection result acquired from the obstacle detection unit 32 and the tracking information acquired from the obstacle tracking unit 38. For example, the monitoring distance determination unit 33*b* determines, as the monitoring distance, a distance from the train 10*b* to the location of the obstacle indicated by the tracking information. In a case where the obstacle is not moving, in a case where the obstacle is moving away at a speed lower than a speed of the train 10*b*, or in a case where the obstacle is moving toward the train 10*b*, the monitoring distance determination unit 33*b* changes the monitoring distance to be short.

The monitoring region determination unit 34*b* determines a monitoring region by using the monitoring distance acquired from the monitoring distance determination unit 33*b* and the tracking information acquired from the obstacle tracking unit 38. The monitoring region determination unit 34*b* may change a size of the monitoring region in accordance with the distance between the train 10*b* and the obstacle, and may change a size, a shape, and the like of the monitoring region in accordance with a size, a shape, and the like of the obstacle when the tracking information includes information of the size, the shape, and the like of the obstacle.

Figure 12:
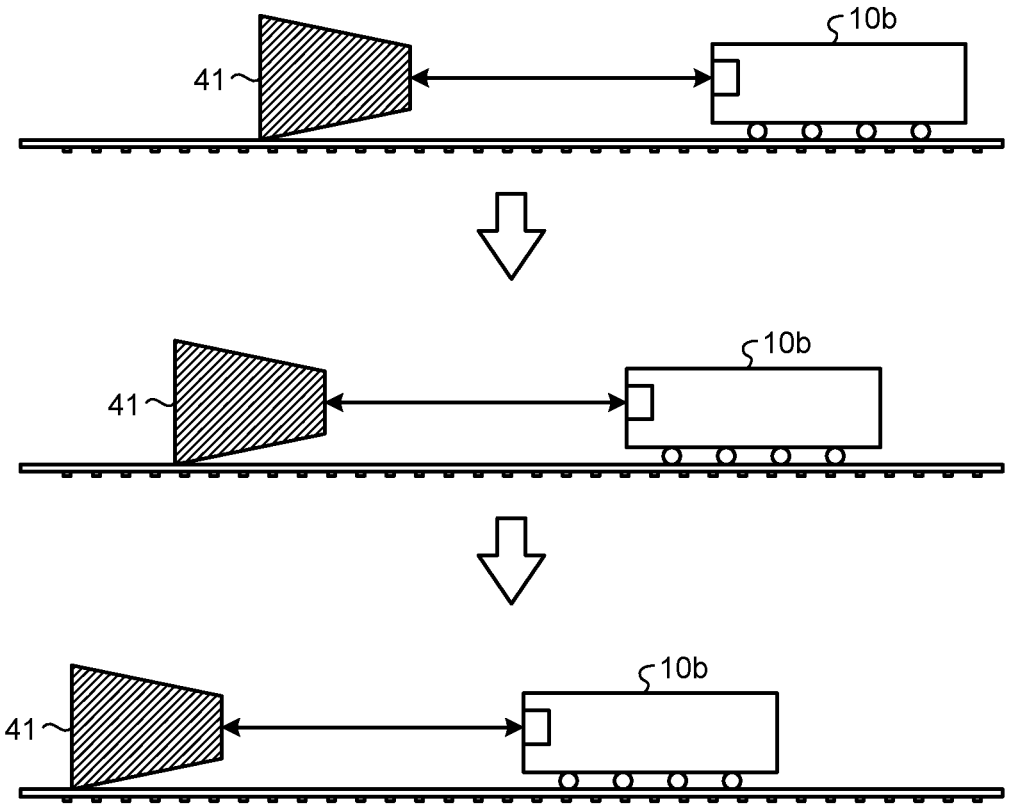
FIG. 12 is a diagram illustrating a locational relationship between the train and a monitoring region based on a monitoring distance determined when there is no obstacle by a monitoring distance determination unit of the obstacle detection device according to the third embodiment.
Figure 13:
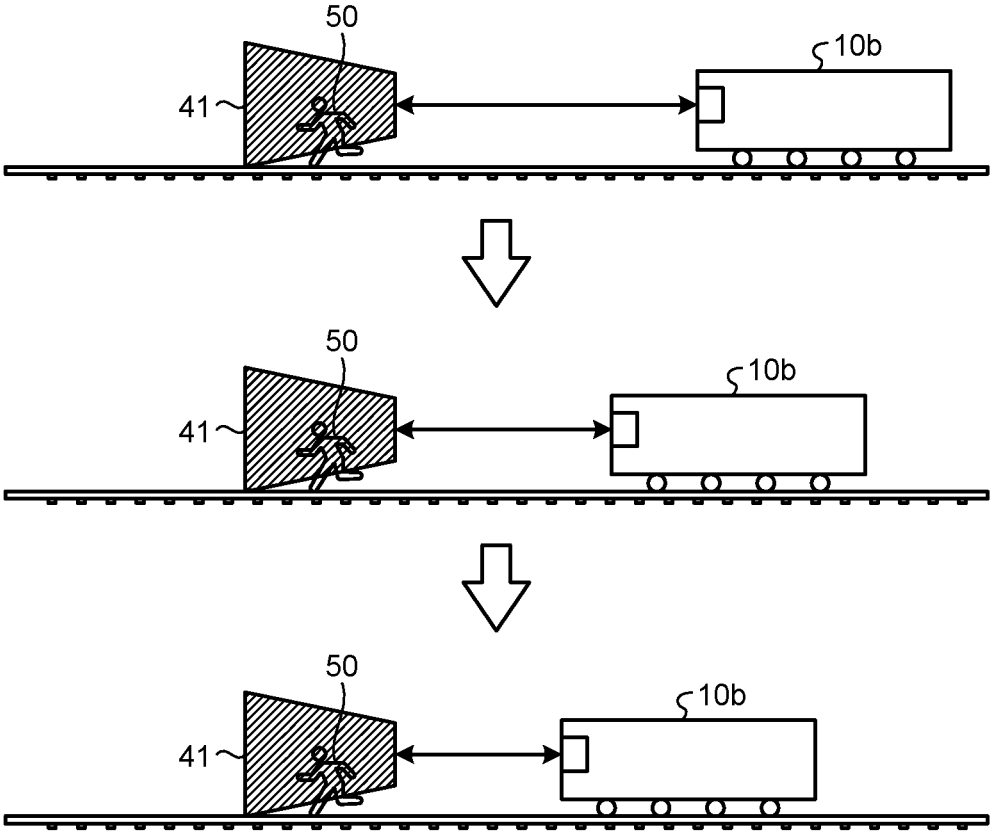
FIG. 13 is a diagram illustrating a locational relationship between the train and a monitoring region based on a monitoring distance determined at a time of obstacle tracking by the monitoring distance determination unit of the obstacle detection device according to the third embodiment.

FIG. 12 is a diagram illustrating a locational relationship between the train 10*b* and a monitoring region based on a monitoring distance determined when there is no obstacle by the monitoring distance determination unit 33*b* of the obstacle detection device 30*b* according to the third embodiment. FIG. 12 illustrates a state in which the obstacle detection device 30*b* monitors the monitoring region 41 based on a constant monitoring distance when there is no obstacle. FIG. 13 is a diagram illustrating a locational relationship between the train 10*b* and a monitoring region based on a monitoring distance determined at a time of obstacle tracking by the monitoring distance determination unit 33*b* of the obstacle detection device 30*b* according to the third embodiment. FIG. 13 illustrates a state in which a distance between the train 10*b* and the monitoring region 41 is becoming shorter as the obstacle detection device 30*b* has changed the monitoring distance in accordance with a location of the obstacle 50. Note that, in FIGS. 12 and 13, a traveling direction of the train 10*b* is a direction from a right side to a left side of the figure. Also in such a case, in the obstacle detection device 30*b*, the monitoring distance determination unit 33*b* changes the monitoring distance such that a region not monitored by the sensor 31 is not generated on the route of the train 10*b*. That is, also when the distance between the train 10*b* and the obstacle 50 is changed in the obstacle tracking unit 38, the monitoring distance determination unit 33*b* changes the monitoring distance such that a part of the first monitoring region overlaps with a part of the second monitoring region.

Figure 14:
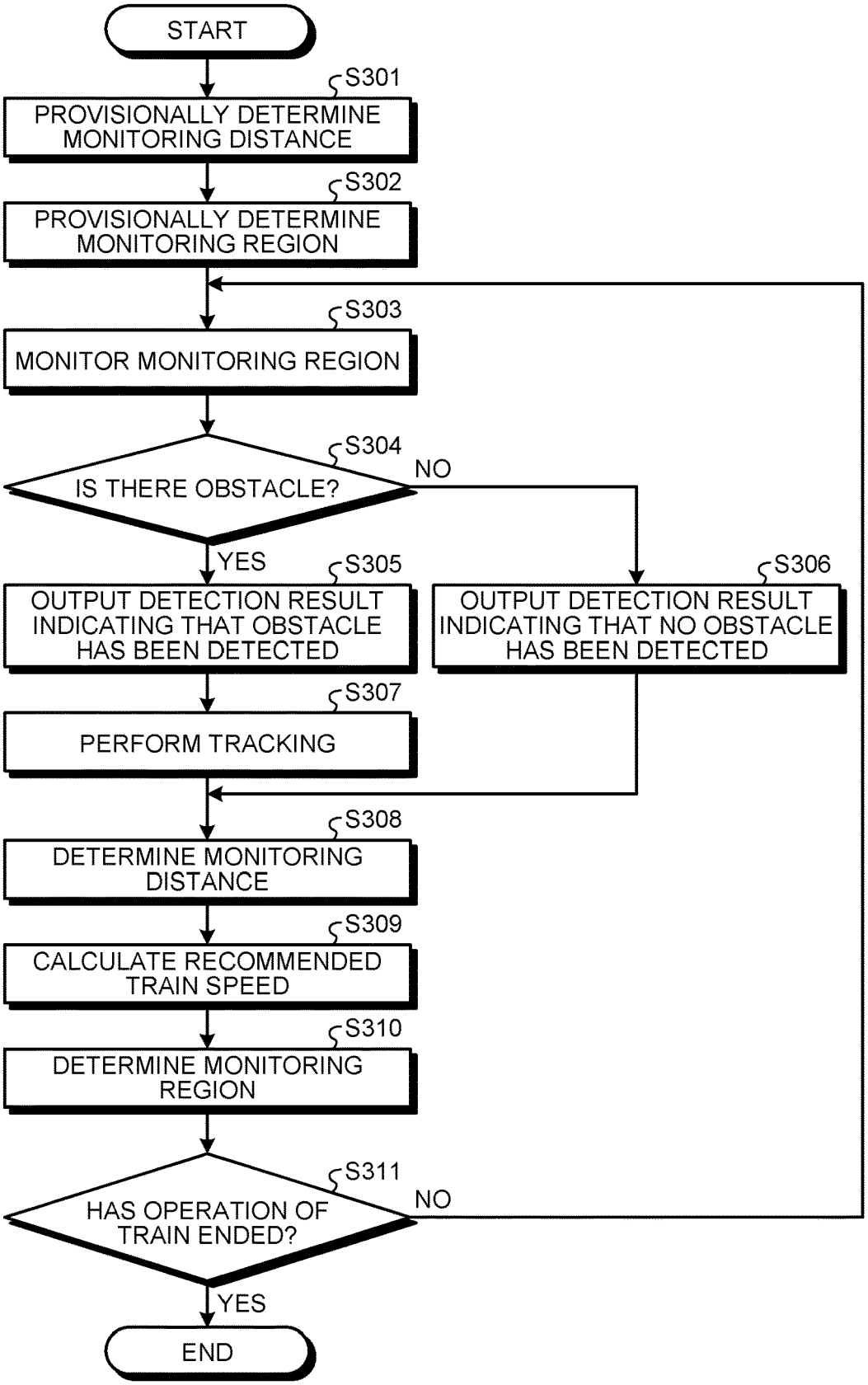
FIG. 14 is a flowchart illustrating an action of the obstacle detection device according to the third embodiment.

An action of the obstacle detection device 30*b* of the present embodiment will be described with reference to a flowchart. FIG. 14 is a flowchart illustrating an action of the obstacle detection device 30*b* according to the third embodiment. Note that descriptions of parts similar to the action of the obstacle detection device 30 of the first embodiment will be simplified. When the train 10*b* is activated, in the obstacle detection device 30*b*, the monitoring distance determination unit 33*b* provisionally determines a monitoring distance (step S301). The monitoring region determination unit 34*b* provisionally determines a monitoring region by using the provisionally determined monitoring distance (step S302). The sensor 31 performs monitoring in the monitoring region acquired from the monitoring region determination unit 34*b* (step S303).

The obstacle detection unit 32 determines presence or absence of an obstacle on the basis of a monitoring result acquired from the sensor 31 (step S304). When there is an obstacle (step S304: Yes), the obstacle detection unit 32 outputs a detection result indicating that an obstacle has been detected, to the train control device 20, the monitoring distance determination unit 33*b*, and the obstacle tracking unit 38 (step S305). When there is no obstacle (step S304: No), the obstacle detection unit 32 outputs a detection result indicating that no obstacle has been detected, to the train control device 20, the monitoring distance determination unit 33*b*, and the obstacle tracking unit 38 (step S306).

The obstacle tracking unit 38 uses a time-series detection result of the obstacle detected by the obstacle detection unit 32, to track the detected obstacle in association (step S307). The obstacle tracking unit 38 outputs tracking information to the monitoring distance determination unit 33*b* and the monitoring region determination unit 34*b*.

The monitoring distance determination unit 33*b* determines a monitoring distance by using the detection result acquired from the obstacle detection unit 32 and the tracking information acquired from the obstacle tracking unit 38 (step S308). In addition, the monitoring distance determination unit 33*b* calculates a recommended train speed of the train 10*b* together with the train control device 20 by using the detection result acquired from the obstacle detection unit 32 and the tracking information acquired from the obstacle tracking unit 38 (step S309). Note that the monitoring distance determination unit 33*b* may change the order of the actions in steps S308 and S309, or may perform the actions in parallel. The monitoring region determination unit 34*b* determines a monitoring region by using the monitoring distance acquired from the monitoring distance determination unit 33*b* and the tracking information acquired from the obstacle tracking unit 38 (step S310).

The obstacle detection device 30*b* determines whether or not the operation of the train 10*b* has ended (step S311). When the operation of the train 10*b* has not ended (step S311: No), the obstacle detection device 30*b* returns to step S303 and repeats the above-described action. When the operation of the train 10*b* has ended (step S311: Yes), the obstacle detection device 30*b* ends the action.

Regarding a hardware configuration of the obstacle detection device 30*b*, the obstacle tracking unit 38 is implemented by processing circuitry. The processing circuitry may be a memory and a processor that executes a program stored in the memory, or may be dedicated hardware.

As described above, according to the present embodiment, in the obstacle detection device 30*b*, the monitoring distance determination unit 33*b* determines the monitoring distance by using the monitoring result and the tracking information. As a result, in addition to the effects of the first embodiment, the obstacle detection device 30*b* can further perform monitoring according to a state of the obstacle.

Fourth Embodiment

In a fourth embodiment, an obstacle detection device determines a monitoring distance so as to track an obstacle detected by the obstacle detection unit 32, in consideration of a monitorable region of the sensor 31 under a current monitoring condition.

Figure 15:
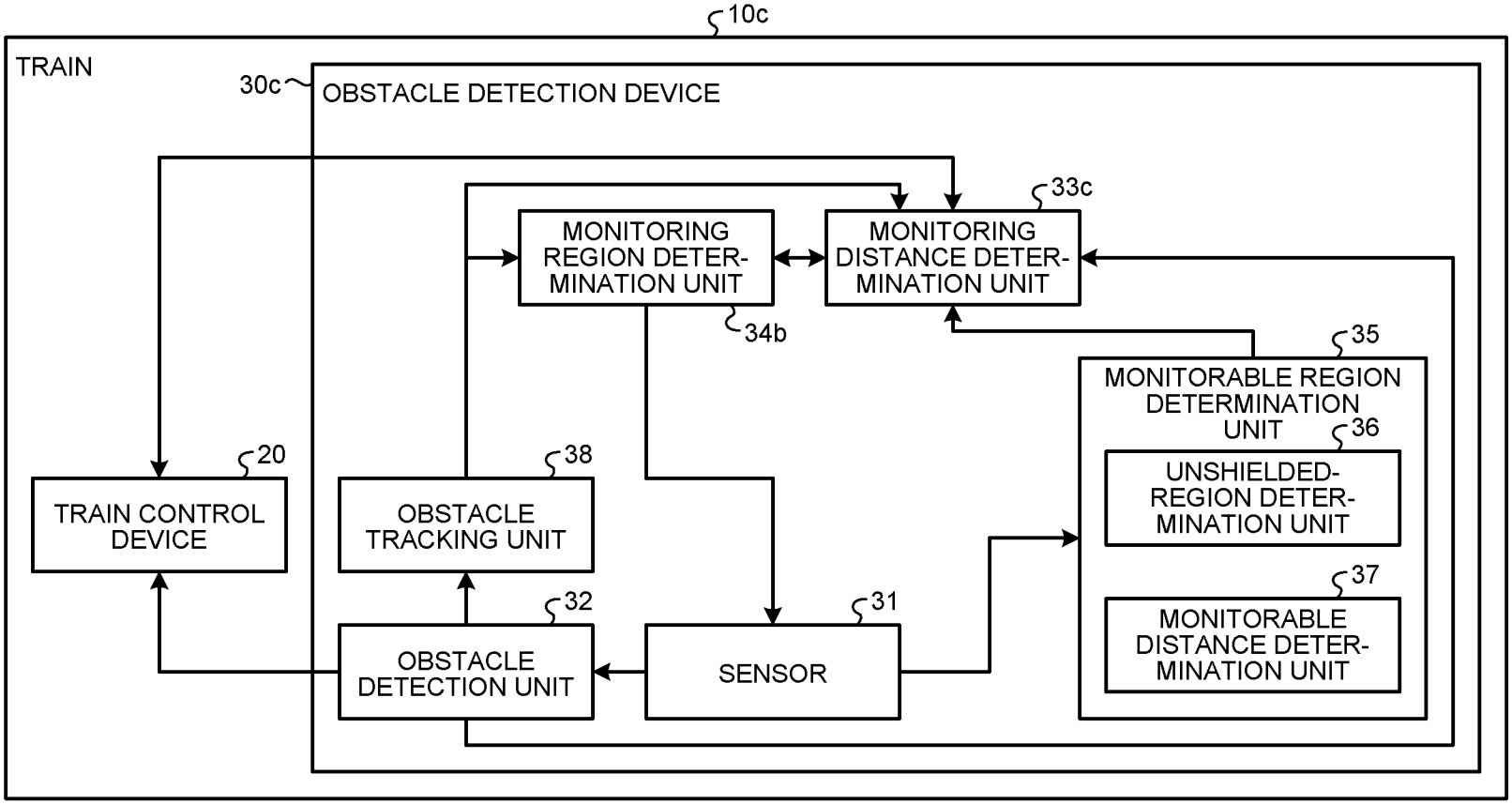
FIG. 15 is a diagram illustrating a configuration example of a train including an obstacle detection device according to a fourth embodiment.

FIG. 15 is a diagram illustrating a configuration example of a train 10*c* including an obstacle detection device 30*c* according to the fourth embodiment. The train 10*c* includes the train control device 20 and the obstacle detection device 30*c*. During operation, the train 10*c* monitors whether or not there is an obstacle on a route by using the obstacle detection device 30*c*. The obstacle detection device 30*c* is installed on the train 10*c* and monitors whether or not there is an obstacle on the route of the train 10*c*. The obstacle detection device 30*c* includes the sensor 31, the obstacle detection unit 32, a monitoring distance determination unit 33*c*, the monitoring region determination unit 34*b*, the monitorable region determination unit 35, and the obstacle tracking unit 38. In the fourth embodiment, an action of the monitorable region determination unit 35 is similar to the action of the monitorable region determination unit 35 of the second embodiment. An action of the obstacle tracking unit 38 is similar to the action of the obstacle tracking unit 38 according to the third embodiment.

The monitoring distance determination unit 33*c* has both the function of the monitoring distance determination unit 33*a* of the second embodiment and the function of the monitoring distance determination unit 33*b* of the third embodiment. That is, the monitoring distance determination unit 33*c* determines a monitoring distance by using a detection result acquired from the obstacle detection unit 32 and tracking information acquired from the obstacle tracking unit 38, within a range of a monitorable region determined by the monitorable region determination unit 35.

Figure 16:
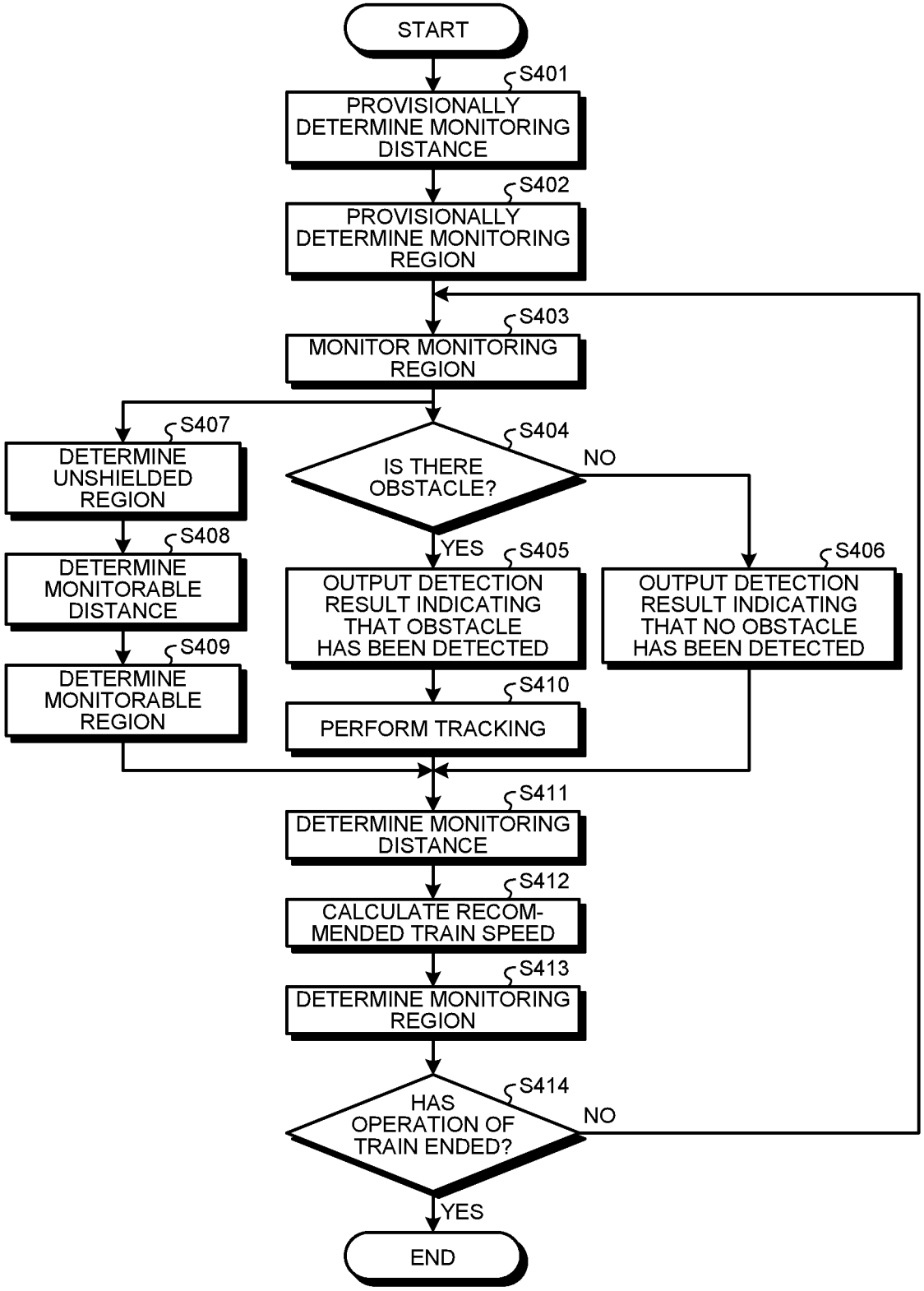
FIG. 16 is a flowchart illustrating an action of the obstacle detection device according to the fourth embodiment.

An action of the obstacle detection device 30*c* of the present embodiment will be described with reference to a flowchart. FIG. 16 is a flowchart illustrating an action of the obstacle detection device 30*c* according to the fourth embodiment. Note that descriptions of parts similar to the action of the obstacle detection device 30 of the first embodiment will be simplified. When the train 10*c* is activated, in the obstacle detection device 30*c*, the monitoring distance determination unit 33*c* provisionally determines a monitoring distance (step S401). The monitoring region determination unit 34*b* provisionally determines a monitoring region by using the provisionally determined monitoring distance (step S402). The sensor 31 performs monitoring in the monitoring region acquired from the monitoring region determination unit 34*b* (step S403). The sensor 31 outputs a monitoring result to the obstacle detection unit 32 and the monitorable region determination unit 35.

The obstacle detection unit 32 determines presence or absence of an obstacle on the basis of the monitoring result acquired from the sensor 31 (step S404). When there is an obstacle (step S404: Yes), the obstacle detection unit 32 outputs a detection result indicating that an obstacle has been detected, to the train control device 20, the monitoring distance determination unit 33*c*, and the obstacle tracking unit 38 (step S405). When there is no obstacle (step S404: No), the obstacle detection unit 32 outputs a detection result indicating that no obstacle has been detected, to the train control device 20, the monitoring distance determination unit 33*c*, and the obstacle tracking unit 38 (step S406).

The unshielded-region determination unit 36 determines an unshielded region that is not subjected to monitoring interference by a shielding object at a location other than the route of the train 10*c* (step S407). The monitorable distance determination unit 37 determines a monitorable distance by the sensor 31 under a current monitoring condition (step S408). The monitorable region determination unit 35 determines a monitorable region on the basis of the unshielded region determined by the unshielded-region determination unit 36 and the monitorable distance determined by the monitorable distance determination unit 37 (step S409). The monitorable region determination unit 35 outputs the determined monitorable region to the monitoring distance determination unit 33*c*.

The obstacle tracking unit 38 uses a time-series detection result of the obstacle detected by the obstacle detection unit 32, to track the detected obstacle in association (step S410). The obstacle tracking unit 38 outputs tracking information to the monitoring distance determination unit 33*c* and the monitoring region determination unit 34*b*.

By using the detection result acquired from the obstacle detection unit 32, the monitorable region acquired from the monitorable region determination unit 35, and the tracking information acquired from the obstacle tracking unit 38, the monitoring distance determination unit 33*c* determines a monitoring distance (step S411). In addition, by using the detection result acquired from the obstacle detection unit 32, the monitorable region acquired from the monitorable region determination unit 35, and the tracking information acquired from the obstacle tracking unit 38, the monitoring distance determination unit 33*c* calculates a recommended train speed of the train 10*c* together with the train control device 20 (step S412). Note that the monitoring distance determination unit 33*c* may change the order of the actions in steps S411 and S412, or may perform the actions in parallel. The monitoring region determination unit 34*b* determines a monitoring region by using the monitoring distance acquired from the monitoring distance determination unit 33*c* and the tracking information acquired from the obstacle tracking unit 38 (step S413). The monitoring region determination unit 34*b* outputs the monitoring region to the sensor 31.

The obstacle detection device 30*c* determines whether or not the operation of the train 10*c* has ended (step S414). When the operation of the train 10*c* has not ended (step S414: No), the obstacle detection device 30*c* returns to step S403 and repeats the above-described action. When the operation of the train 10*c* has ended (step S414: Yes), the obstacle detection device 30*c* ends the action.

As described above, according to the present embodiment, in the obstacle detection device 30*c*, the monitoring distance determination unit 33*c* determines the monitoring distance by using the monitoring result, the monitorable region, and the tracking information. As a result, in addition to the effects of the first embodiment, the obstacle detection device 30*c* can perform monitoring according to a state of an obstacle while avoiding unnecessary monitoring, by monitoring in a monitorable region without monitoring a long distance in a state where the sensor 31 cannot monitor a long distance.

The configurations illustrated in the above embodiments illustrate one example and can be combined with another known technique, and it is also possible to combine embodiments with each other and omit and change a part of the configuration without departing from the subject matter of the present disclosure.

REFERENCE SIGNS LIST

10, 10*a*, 10*b*, 10*c* train; 20 train control device; 30, 30*a*, 30*b*, 30*c* obstacle detection device; 31 sensor; 32 obstacle detection unit; 33, 33*a*, 33*b*, 33*c* monitoring distance determination unit; 34, 34*b* monitoring region determination unit; 35 monitorable region determination unit; 36 unshielded-region determination unit; 37 monitorable distance determination unit; 38 obstacle tracking unit; 40, 41, 41*a* to 41*f* monitoring region; 50 obstacle; 60 tunnel; 61*a*, 61*b* monitorable region.

The invention claimed is:

1. An obstacle detection device to be installed on a train, the obstacle detection device comprising:

a sensor to monitor a monitoring region and output a monitoring result;

an obstacle detection circuitry to determine presence or absence of an obstacle on a route of the train based on the monitoring result, and output a detection result;

a monitoring distance determination circuitry to use the detection result to determine a monitoring distance from the train to a reference for monitoring by the sensor in front of the train; and a monitoring region determination circuitry to use the monitoring distance to determine the monitoring region to be monitored by the sensor, wherein when changing the monitoring distance, the monitoring distance determination circuitry acquires the monitoring region from the monitoring region determination circuitry, and changes the monitoring distance such that a part of a first monitoring region that has been monitored overlaps with a part of a second monitoring region based on the changed monitoring distance, in order not to generate a region that is not monitored by the sensor on a route of the train.

2. The obstacle detection device according to claim 1, comprising:

a monitorable region determination circuitry to determine a monitorable region of the sensor under a current monitoring condition, wherein the monitoring distance determination circuitry determines the monitoring distance within a range of the monitorable region determined by the monitorable region determination circuitry.

3. The obstacle detection device according to claim 2, wherein the monitorable region determination circuitry includes:

an unshielded-region determination circuitry to determine an unshielded region that is not subjected to monitoring interference by a shielding object, the shielding object being an object other than the obstacle and hindering monitoring of the sensor at a location other than a route of the train; and a monitorable distance determination circuitry to determine a monitorable distance that is a distance that can be monitored by the sensor under the current monitoring condition.

4. The obstacle detection device according to claim 2, wherein in a case where a monitorable region of the sensor under a previous monitoring condition and a monitorable region of the sensor under the current monitoring condition are different, the monitorable regions being determined by the monitorable region determination circuitry, the monitoring distance determination circuitry changes the monitoring distance such that a part of the first monitoring region overlaps with a part of the second monitoring region.

5. The obstacle detection device according to claim 1, comprising:

an obstacle tracking circuitry to use a time-series detection result of the obstacle detected by the obstacle detection circuitry to track the detected obstacle in association, and output tracking information indicating a location of the obstacle, wherein the monitoring distance determination circuitry determines the monitoring distance by using the detection result and the tracking information.

6. The obstacle detection device according to claim 5, wherein when a distance between the train and the obstacle is changed in the obstacle tracking circuitry, the monitoring distance determination circuitry changes the monitoring distance such that a part of the first monitoring region overlaps with a part of the second monitoring region.

7. The obstacle detection device according to claim 1, wherein the monitoring distance determination circuitry calculates a recommended train speed that is a speed recommended in the train together with a train control device that controls traveling of the train, based on the monitoring distance and a braking distance of the train.

8. An obstacle detection method for an obstacle detection device to be installed on a train, the obstacle detection method comprising:

performing monitoring, by a sensor, to monitor a monitoring region and output a monitoring result;

performing obstacle detection, by an obstacle detection circuitry, to determine presence or absence of an obstacle on a route of the train based on the monitoring result, and output a detection result;

performing monitoring distance determination, by a monitoring distance determination circuitry, to use the detection result to determine a monitoring distance from the train to a reference for monitoring by the sensor in front of the train; and performing monitoring region determination, by a monitoring region determination circuitry, to use the monitoring distance to determine the monitoring region to be monitored by the sensor, wherein in performing the monitoring distance determination, when changing the monitoring distance, the monitoring distance determination circuitry acquires the monitoring region from the monitoring region determination circuitry, and changes the monitoring distance such that a part of a first monitoring region that has been monitored overlaps with a part of a second monitoring region based on the changed monitoring distance, in order not to generate a region that is not monitored by the sensor on a route of the train.

9. The obstacle detection method according to claim 8, comprising:

performing monitorable region determination, by a monitorable region determination circuitry, to determine a monitorable region of the sensor under a current monitoring condition, wherein in performing the monitoring distance determination, the monitoring distance determination circuitry determines the monitoring distance within a range of the monitorable region determined by the monitorable region determination circuitry.

10. The obstacle detection method according to claim 9, wherein the monitorable region determination circuitry includes an unshielded-region determination circuitry and a monitorable distance determination circuitry, and performing the monitorable region determination includes:

performing unshielded-region determination, by the unshielded-region determination circuitry, to determine an unshielded region that is not subjected to monitoring interference by a shielding object, the shielding object being an object other than the obstacle and hindering monitoring of the sensor at a location other than a route of the train; and performing monitorable distance determination, by the monitorable distance determination circuitry, to determine a monitorable distance that is a distance that can be monitored by the sensor under the current monitoring condition.

11. The obstacle detection method according to claim 9, wherein in performing the monitoring distance determination, in a case where a monitorable region of the sensor under a previous monitoring condition and a monitorable region of the sensor under the current monitoring condition are different, the monitorable regions being determined by the monitorable region determination circuitry, the monitoring distance determination circuitry changes the monitoring distance such that a part of the first monitoring region overlaps with a part of the second monitoring region.

12. The obstacle detection method according to claim 8, comprising:

performing obstacle tracking, by an obstacle tracking circuitry, to use a time-series detection result of the obstacle detected by the obstacle detection circuitry to track the detected obstacle in association, and output tracking information indicating a location of the obstacle, wherein in performing the monitoring distance determination, the monitoring distance determination circuitry determines the monitoring distance by using the detection result and the tracking information.

13. The obstacle detection method according to claim 12, wherein in performing the monitoring distance determination, when a distance between the train and the obstacle is changed in the obstacle tracking circuitry, the monitoring distance determination circuitry changes the monitoring distance such that a part of the first monitoring region overlaps with a part of the second monitoring region.

14. The obstacle detection method according to claim 8, comprising:

performing recommended train speed calculation, by the monitoring distance determination circuitry, to calculate a recommended train speed that is a speed recommended in the train together with a train control device that controls traveling of the train, based on the monitoring distance and a braking distance of the train.

* * * * *